US007712926B2

(12) United States Patent
Matheson

(10) Patent No.: US 7,712,926 B2
(45) Date of Patent: May 11, 2010

(54) LUMINAIRE COMPRISING ADJUSTABLE LIGHT MODULES

(75) Inventor: George E. Matheson, North Vancouver (CA)

(73) Assignee: Koninklijke Philips Electronics N.V., Eindhoven (NL)

( * ) Notice: Subject to any disclaimer, the term of this patent is extended or adjusted under 35 U.S.C. 154(b) by 183 days.

(21) Appl. No.: 11/893,486

(22) Filed: Aug. 16, 2007

(65) Prior Publication Data

US 2008/0068839 A1 Mar. 20, 2008

Related U.S. Application Data

(60) Provisional application No. 60/822,729, filed on Aug. 17, 2006.

(51) Int. Cl.
*F21V 29/00* (2006.01)
*F21V 17/06* (2006.01)
*F21V 17/00* (2006.01)

(52) U.S. Cl. ..... 362/294; 362/249.01; 362/249.02; 362/249.1; 362/219; 362/433; 362/455

(58) Field of Classification Search ..... 362/227, 362/240, 249, 294, 250, 217, 218, 219, 222, 362/223, 225, 433, 455, 249.01, 249.02, 362/249.1, 217.02
See application file for complete search history.

(56) References Cited

U.S. PATENT DOCUMENTS 4,025,777 A * 5/1977 Hayakawa ..... 362/249.07
4,729,077 A 3/1988 Gordin et al.
5,386,354 A 1/1995 Osteen
5,523,929 A * 6/1996 Ogihara ..... 362/183
5,907,648 A 5/1999 Miller et al.
6,019,477 A 2/2000 Wegrzyn et al.
6,193,395 B1 2/2001 Logan
6,200,011 B1 3/2001 Miller et al.
6,783,258 B2 * 8/2004 Ryan, Jr. ..... 362/249.03
6,814,459 B2 * 11/2004 Pederson ..... 362/35
6,877,876 B1 4/2005 Steinhilber
6,916,105 B2 * 7/2005 Zerphy et al. ..... 362/647
6,942,363 B1 9/2005 LeVasseur
6,945,671 B1 9/2005 Swarens et al.
6,971,767 B2 * 12/2005 Agabekov et al. ..... 362/236
7,159,997 B2 * 1/2007 Reo et al. ..... 362/240
7,303,301 B2 * 12/2007 Koren et al. ..... 362/101
7,470,049 B2 * 12/2008 Walser et al. ..... 362/494
7,513,637 B2 * 4/2009 Kelly et al. ..... 362/126

(Continued)

FOREIGN PATENT DOCUMENTS

CA 1335889 6/1995

(Continued)

*Primary Examiner*—Jacob Y Choi
(74) *Attorney, Agent, or Firm*—John F. Salazar

(57) ABSTRACT

The invention provides a general illumination luminaire comprising one or more adjustable light modules. In particular, the luminaire generally comprises one or more light modules, each one of which comprising one or more light-emitting elements, and optionally comprising a heat sink in thermal contact therewith and output optics for managing light output from the one or more light emitting elements. In general, the light modules are adjustably coupled to the luminaire via a coupling structure that provides one or more adjustment mechanisms for adjusting the orientation of the light modules for adjusting an output directionality of the luminaire, while substantially maintaining the spatial profile of the luminaire.

9 Claims, 15 Drawing Sheets

U.S. PATENT DOCUMENTS

| | | | | |
|---|---|---|---|---|
| 7,572,027 | B2 * | 8/2009 | Zampini et al. | 362/225 |
| 2003/0156416 | A1 * | 8/2003 | Stopa et al. | 362/294 |
| 2005/0018434 | A1 | 1/2005 | Giuliano | |
| 2005/0128751 | A1 * | 6/2005 | Roberge et al. | 362/276 |
| 2005/0168999 | A1 * | 8/2005 | Sommers et al. | 362/427 |
| 2006/0023461 | A1 | 2/2006 | Knight | |
| 2007/0285920 | A1 * | 12/2007 | Seabrook | 362/240 |
| 2008/0278941 | A1 * | 11/2008 | Logan et al. | 362/234 |

FOREIGN PATENT DOCUMENTS

| | | | |
|---|---|---|---|
| WO | 2005/025932 | A2 | 3/2005 |

* cited by examiner

LUMINAIRE COMPRISING ADJUSTABLE LIGHT MODULES

RELATED APPLICATION

This application claims priority to and the benefit of U.S. provisional patent application no. 60/822,729, filed on Aug. 17, 2006, the entire disclosure of which is incorporated by reference herein.

FIELD OF THE INVENTION

The invention pertains to the field of lighting and in particular to a luminaire comprising adjustable light modules.

BACKGROUND

Advances in the development and improvements of the luminous flux of light-emitting devices such as solid-state semiconductor and organic light-emitting diodes (LEDs) have made these devices suitable for use in general illumination applications, including architectural, entertainment, and roadway lighting. Light-emitting diodes are becoming increasingly competitive with light sources such as incandescent, fluorescent, and high-intensity discharge lamps.

One challenge common to all light sources, and particularly to all light sources used in general and specific illumination applications wherein the visual appearance and/or aesthetics of a given light source may be of importance, or at least of interest, resides in the conceptual, configurational and/or architectural design of a light source which provides adequate lighting for the application while generating minimal visual clutter. In other words, a specific or general purpose light source used in a given environment, such as a luminaire, or the like, should provide adequate lighting while remaining visually pleasing within the context of the given environment.

One type of light source which provides particular challenges in this context are light sources configured to provide an adjustable output, namely with regards to directionality and shape. For instance, various currently available light sources provide such adjustments to the directionality and/or shape of an output beam, but do not provide adequate solutions for providing a visually and aesthetically pleasing design that reduces visual clutter.

For example, U.S. Pat. No. 4,729,077 and U.S. Pat. No. 6,942,363 describe lighting devices having an adjustable lamp direction and output beam width. A reflector and discharge or arc lamp are mounted to an adjustable mount for tilting and panning the lighting device while a position of the lamp is further adjustable relative to the reflector along an optical axis thereof to adjust the output beam width.

U.S. Pat. No. 6,945,671 describes a similar light source mounted on a pivoting support, wherein fluorescent tubes are disposed within a concave reflector at any one of three positions along an optical axis thereof to select a desired output beam width.

Also, in U.S. Pat. No. 5,386,354 a lamp fixture is described to include a lamp fixedly mounted within an adjustable domed reflector configured to pivot relative to a base of the fixture to direct light in a selected direction.

In U.S. Pat. No. 6,193,395 a lighting device is described to comprise two lamp assemblies, each having a respective lamp and output lens, which are adjustably mounted to a base unit via respective internal tracks that allow for the independent orientation of each lamp assembly relative to the base unit. Rotation of a bezel fixedly holding the output lens of a given light assembly moves this output lens relative to the lamp thereby adjusting an output beam width.

Similarly, in U.S. Pat. No. 6,877,876 a variable beam flashlight is described to include a lamp axially movable relative to a fixed output lens, thereby also allowing adjustment of an output beam width.

In U.S. Pat. Nos. 5,907,648 and 6,200,011, luminaires are described to include a light source, such as a lamp or optical fibre assembly, which is moveable relative to a fixed output lens to selectively control output directionality and beam width.

Similarly, in United States Patent Application No. 2005/0018434 a positional luminaire is described to include one or more LEDs moveable via an X, Y and/or Z translation relative to an output lens to again adjust an output directionality and beam width.

Furthermore, other currently available light sources providing an adjustable output have been developed for the automobile industry. One example of an adjustable automobile light source is provided in United States Patent Application No. 2006/0023461 wherein an angle and direction of a light beam generated by a vehicle's spot lights are adjusted for driving conditions and circumstances.

The above examples, however, are generally mainly focused on the adjustability of a light source's output, primarily via a displacement of the light source's lighting element relative to the light source's output optics, while providing little or no attention to its general structural, configurational and/or architectural disposition, and/or overall visual or aesthetic impact on its environment.

Furthermore, typical luminaires, such as track light fixtures and the like, must change shape or spatial position in order to change the direction of the projected light beam. For example, the result of aiming a row of track heads on a track light may generate significant visual clutter, illustratively described as "Dead Bats" by architects and designers.

Consequently, there is a need for an improved light source, such as a luminaire or the like, that addresses some of the drawbacks of known sources.

This background information is provided to reveal information believed by the applicant to be of possible relevance to the invention. No admission is necessarily intended, nor should be construed, that any of the preceding information constitutes prior art against the invention.

SUMMARY OF THE INVENTION

An object of the invention is to provide a luminaire comprising adjustable light modules. In accordance with an aspect of the invention, there is provided a luminaire for providing general illumination, comprising: a housing defining a spatial profile of the luminaire, said housing comprising an output portion; and one or more light modules pivotally coupled within said housing, each of said one or more light modules comprising a light-emitting element, and a respective heat sink and output optics therefor; wherein said one or more light modules are configured to pivot within said housing to thereby adjust a directionality of the light emitted therefrom through said output portion while substantially maintaining the spatial profile of the luminaire.

In accordance with another aspect of the invention, there is provided a light module for use in a general illumination luminaire, the light module comprising: a heat sink; a light-emitting element; and an output-optics attachment comprising an output optical element and an attachment element, said output-optics attachment being configured to engage said heat sink and said light-emitting element via said attachment element to maintain a thermal coupling between said light-emitting element and said heat sink, while positioning said optical element in optical alignment with an output of said light-emitting element.

In accordance with a further aspect of the invention, there is provided a luminaire for providing general illumination, comprising: a coupling structure comprising a base portion and a substantially longitudinal light-module coupling portion, said light-module coupling portion being pivotally coupled to said base portion to pivot about a longitudinal axis substantially parallel to said light module coupling portion; and a linear array of light modules each comprising a light-emitting element and each being pivotally coupled along said light-module coupling portion to pivot about a respective transversal axis that is substantially perpendicular to said longitudinal axis; wherein pivotal movement of each of said light modules provides for adjustment of directionality of the luminaire while substantially maintaining a spatial profile thereof.

DETAILED DESCRIPTION OF THE INVENTION

Definitions

Figure 1A:
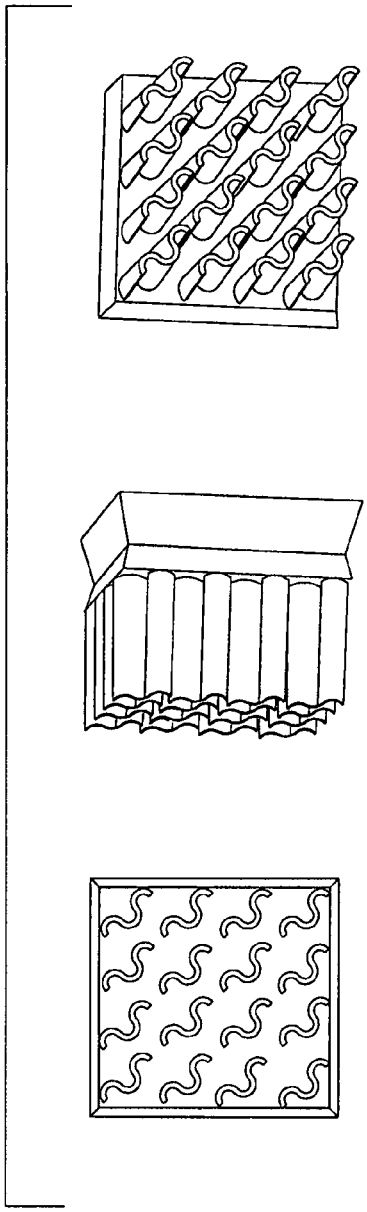
FIGS. 1A-1F illustrate heat sink designs for a light module in accordance with embodiments of the invention, wherein each heat sink design is illustrated in a top perspective view, side perspective view and a top view.
Figure 1B:
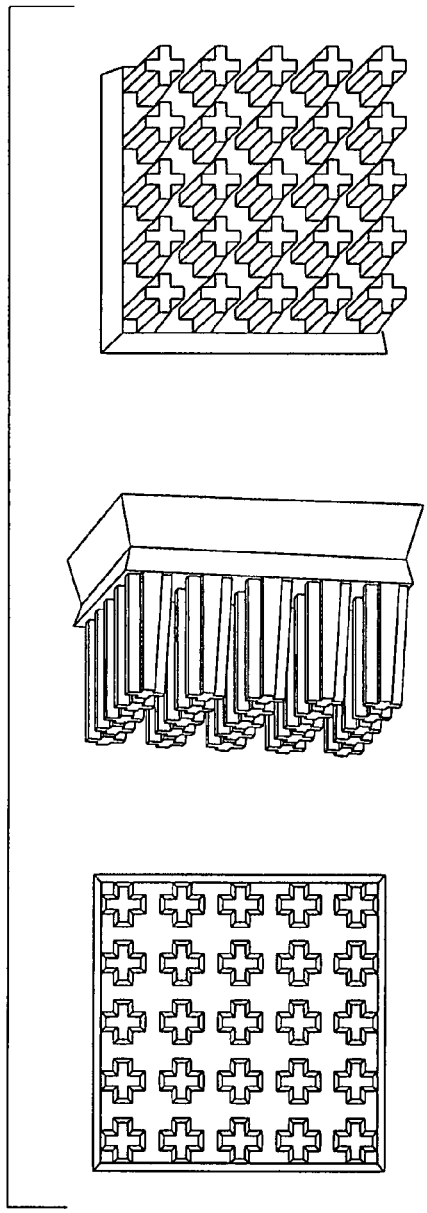
Figure 1C:
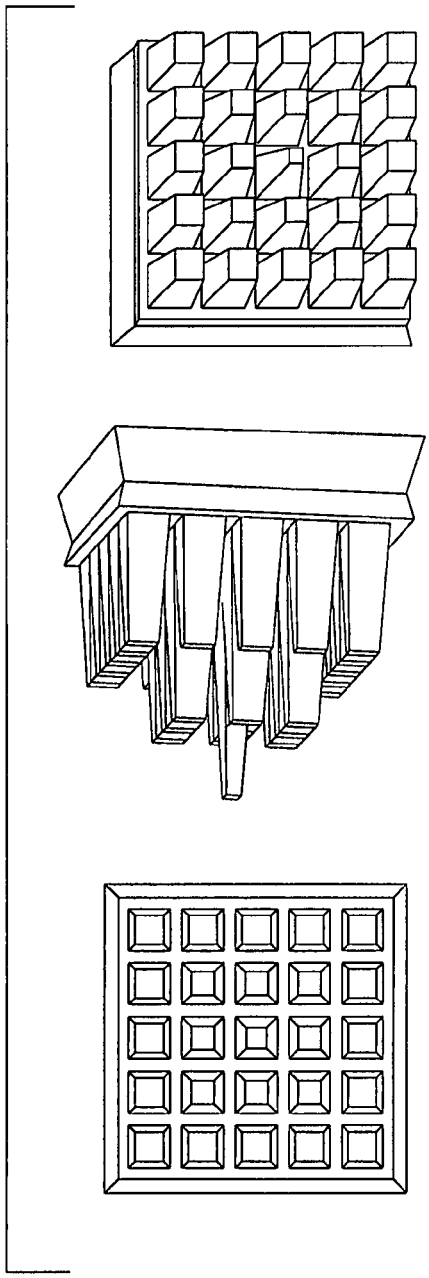
Figure 1D:
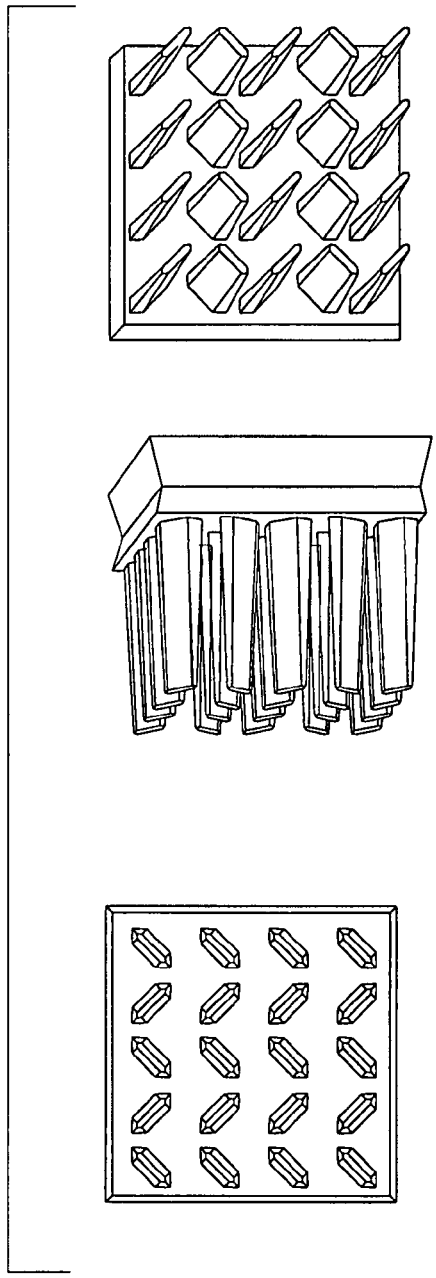
Figure 1E:
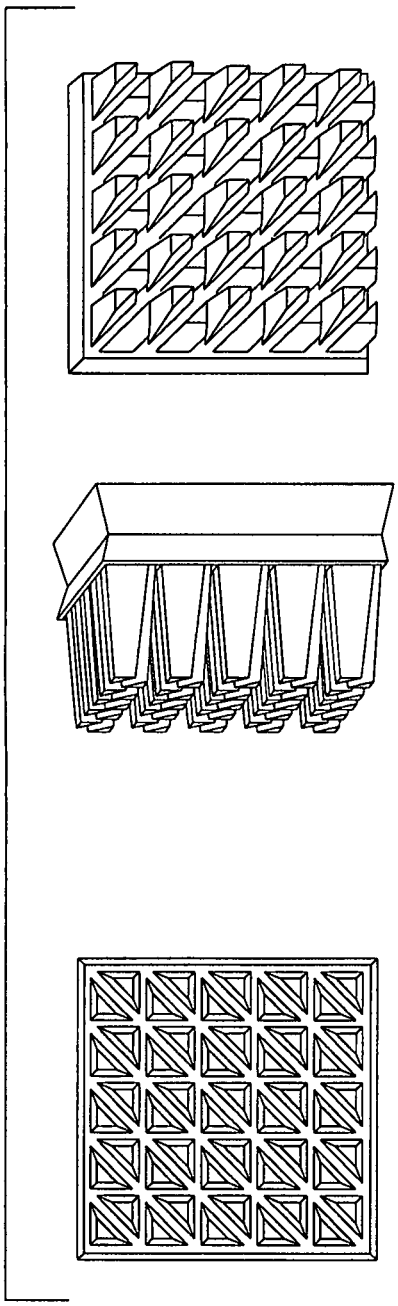
Figure 1F:
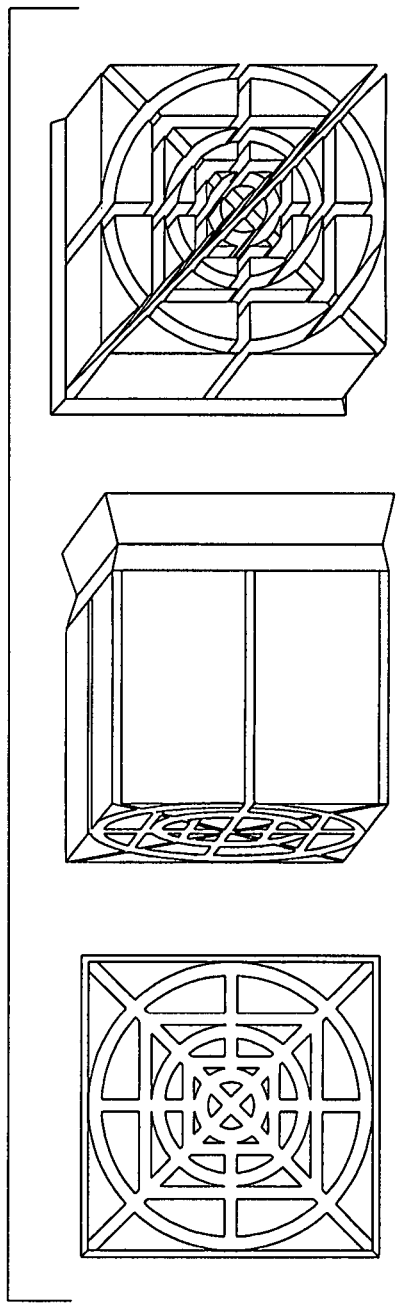
Figure 2:
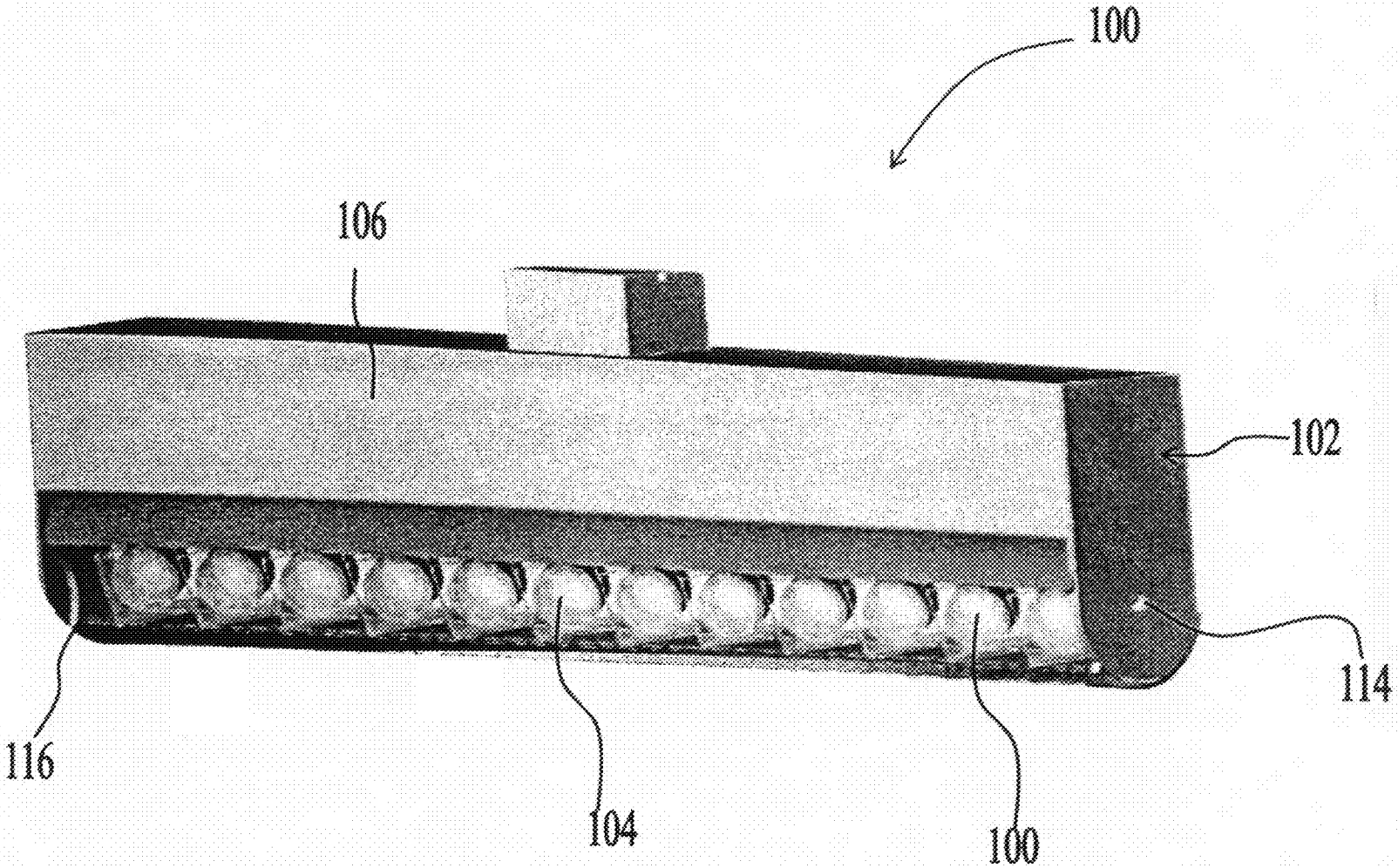
FIG. 2 is a perspective view of a luminaire comprising adjustable light modules in accordance with one embodiment of the invention.
Figure 3:
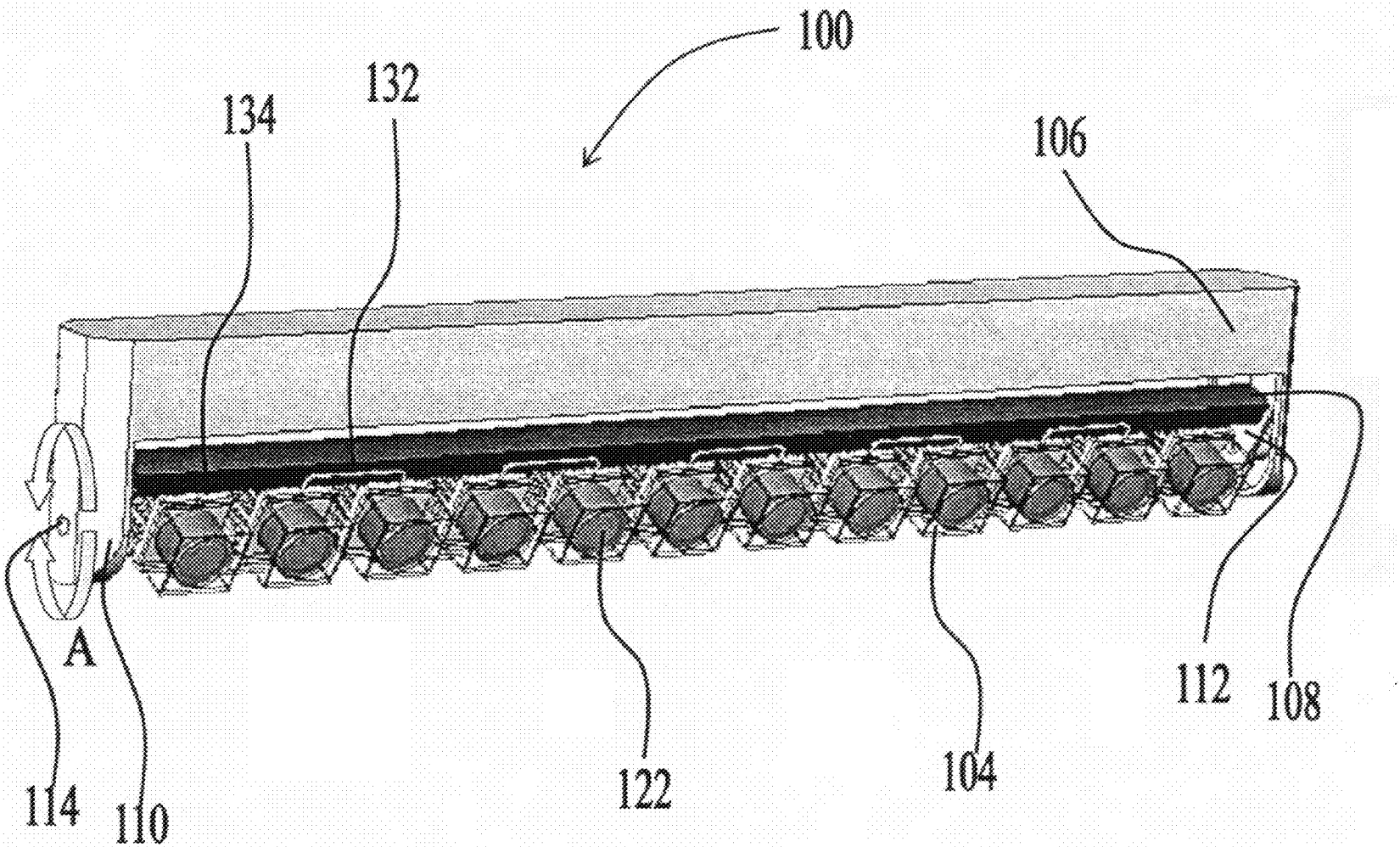
FIG. 3 is a perspective view of the luminaire of FIG. 2 with a transparent portion of a housing thereof removed.
Figure 4:
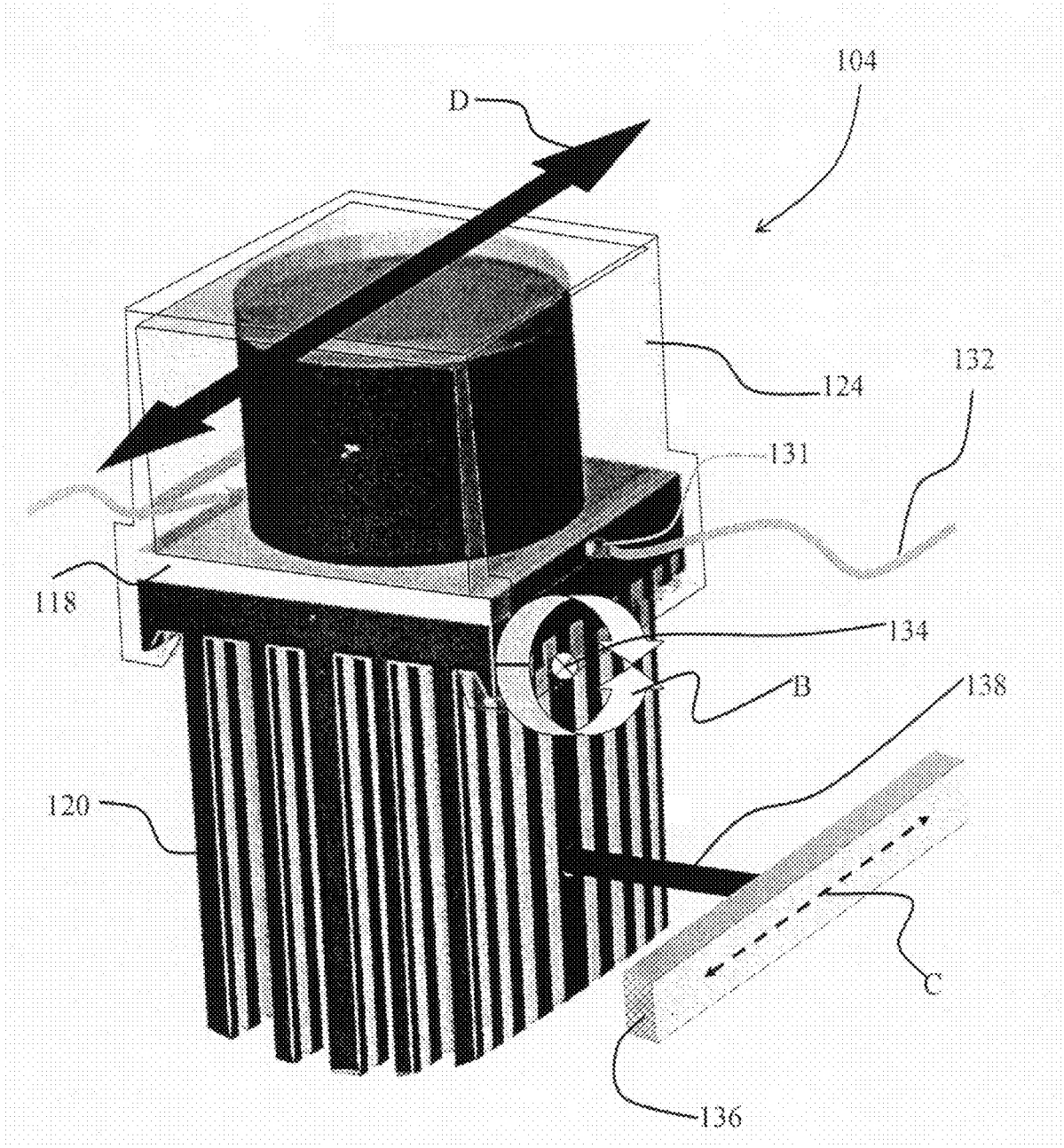
FIG. 4 is a perspective view of one of the light modules of the luminaire of FIG. 2.
Figure 5:
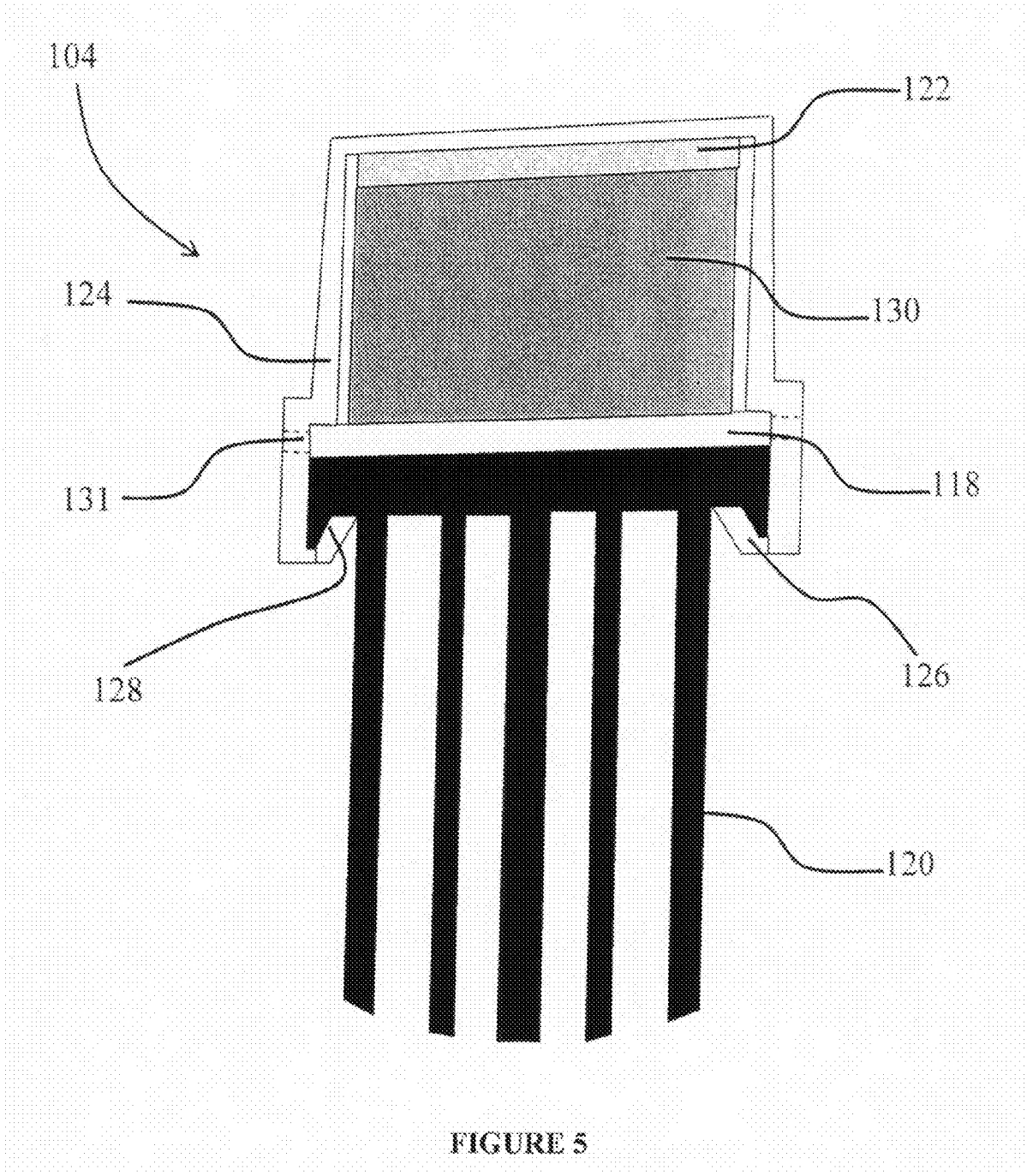
FIG. 5 is a front side view of the light module of FIG. 4.
Figure 6:
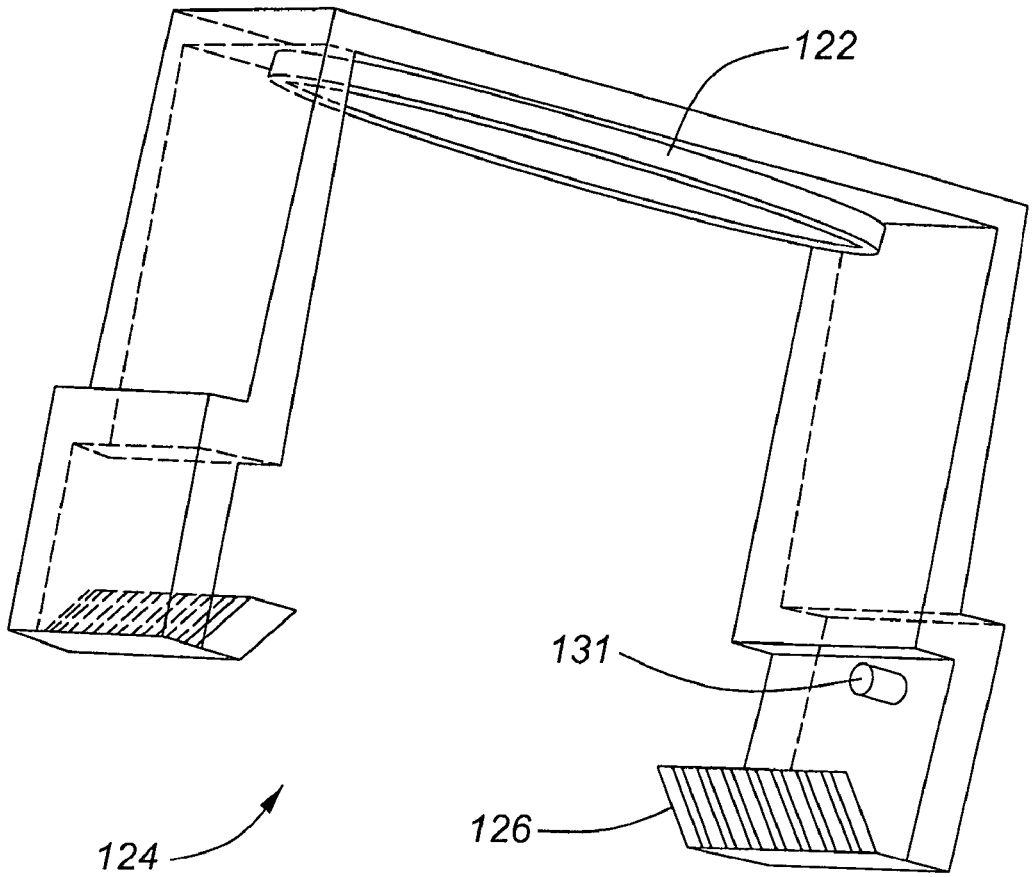
FIG. 6 is a perspective view of an output-optics attachment of the light module of FIG. 4.
Figure 7A:
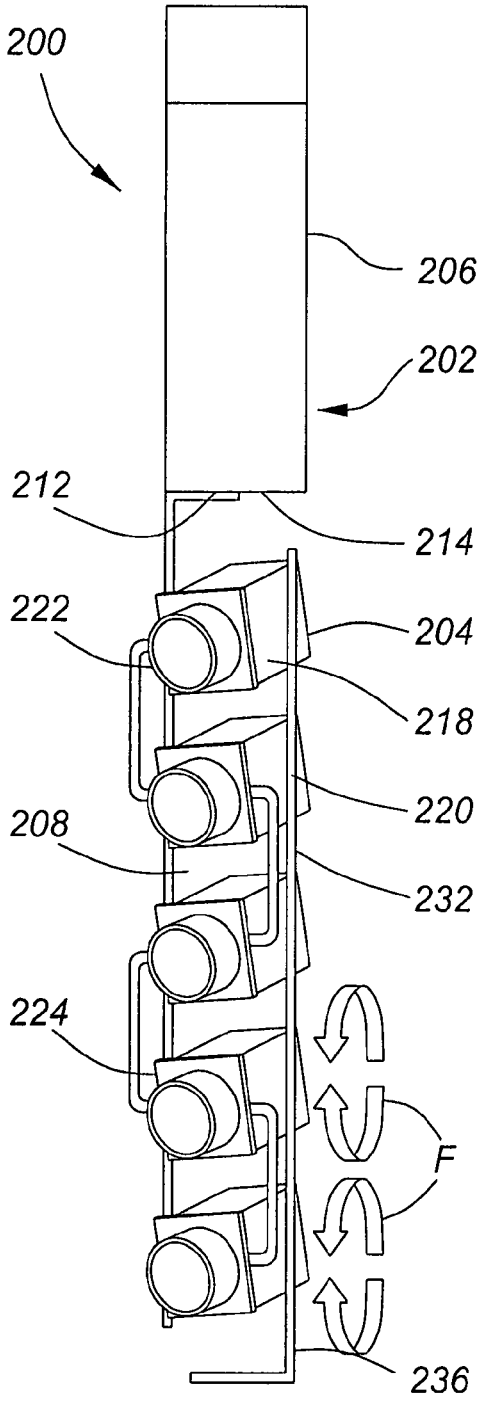
FIGS. 7A to 7F are perspective views of a luminaire comprising adjustable light modules in accordance with another embodiment of the invention.
Figure 7B:
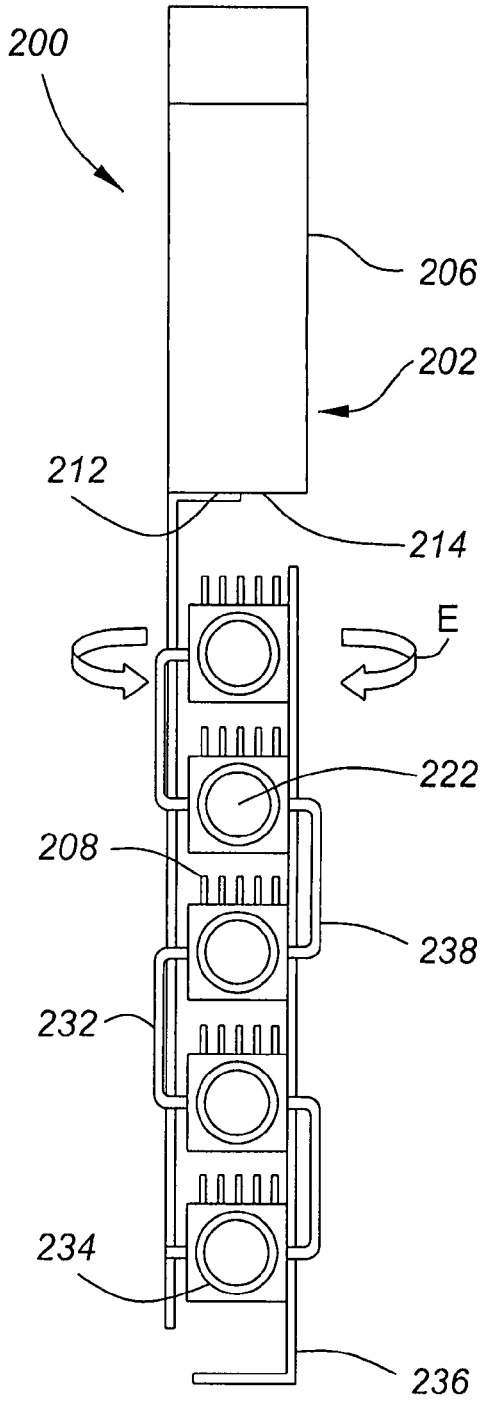
Figure 7C:
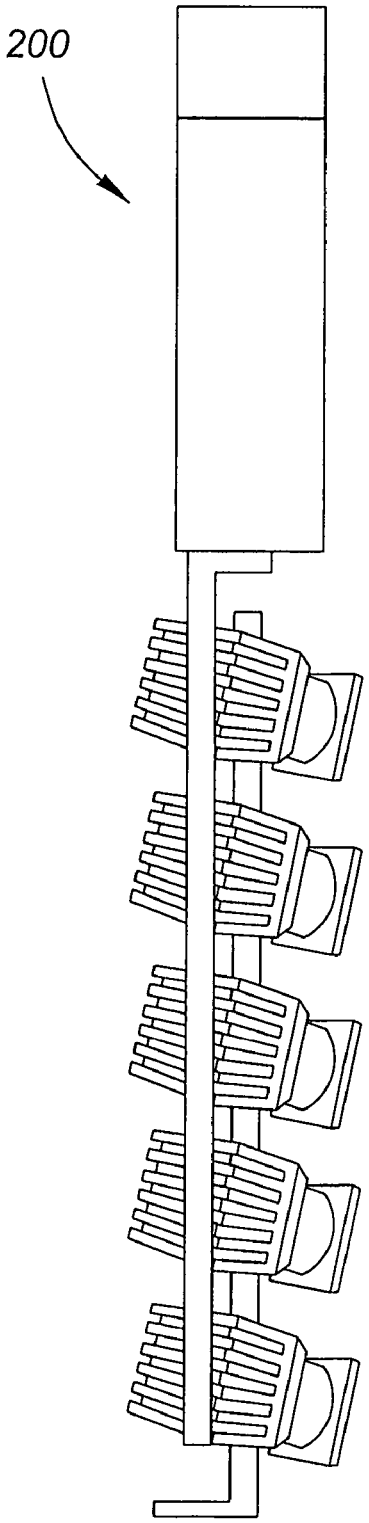
Figure 7D:
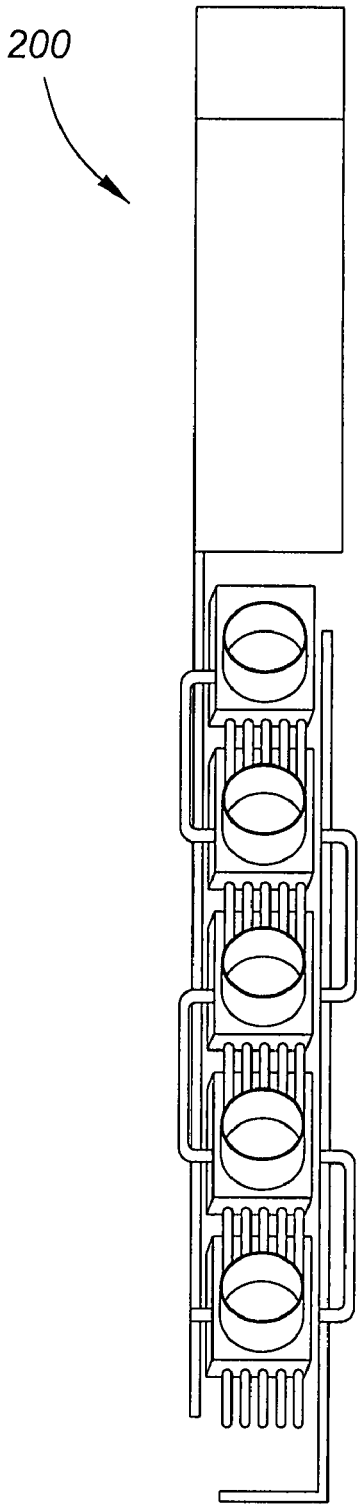
Figure 7E:
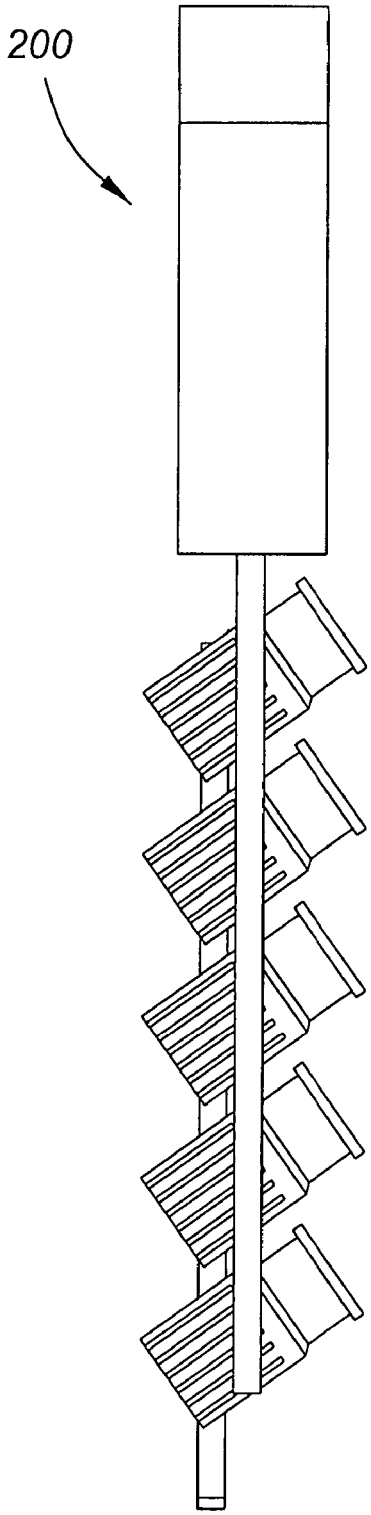
Figure 7F:
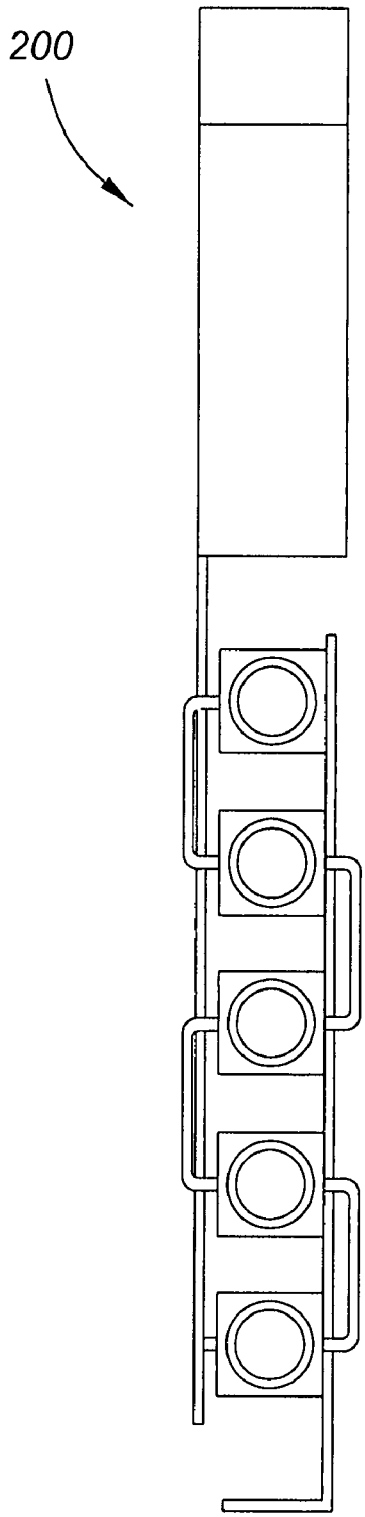

The term "light-emitting element" is used to define a device that emits radiation in a region or combination of regions of the electromagnetic spectrum for example, the visible region, infrared and/or ultraviolet region, when activated by applying a potential difference across it or passing a current through it, for example. Therefore a light-emitting element can have monochromatic, quasi-monochromatic, polychromatic or broadband spectral emission characteristics. Examples of light-emitting elements include semiconductor, organic, or polymer/polymeric light-emitting diodes, optically pumped phosphor coated light-emitting diodes, optically pumped nano-crystal light-emitting diodes or other similar devices as would be readily understood by a worker skilled in the art. Furthermore, the term light-emitting element is used to define the specific device that emits the radiation, for example a LED die, and can equally be used to define a combination of the specific device that emits the radiation together with a housing or package within which the specific device or devices are placed.

The term "spatial profile" is generally used to define the general overall three dimensional configuration and/or appearance of an object, and in the present context, of a given luminaire. For instance, the spatial profile of a luminaire may be defined by the general overall volumetric shape and/or appearance of the luminaire in a given setting, namely defined by a combination of the luminaire's overall position, alignment, shape, disposition, architectural symmetry and/or other such characteristic readily understood by a worker skilled in the art.

The term "luminaire" is generally used to define a light source, lighting unit and/or light fixture, primarily used in general illumination application, comprising one or more light-emitting elements together with a combination of parts designed to support, position and/or provide power to the one or more light-emitting elements. Other such parts, which may include but are not limited to various optical elements for collecting, mixing, collimating, diffusing, focusing and/or orienting light output from the one or more light-emitting elements, optionally in conjunction with various electrical and/or mechanical adjustment mechanism, may also be comprised in a given luminaire, as should be readily apparent to a worker skilled in the art. Furthermore, the term "luminaire" is generally used to define a light source, lighting unit and/or light fixture that may be portable and/or mountable to a wall, ceiling, furniture (e.g., bookcase, shelving unit, display case, cabinet, etc.) and/or other such support structure.

The terms "pivot", "pivoting" and "pivotally" are generally used to relate to rotational motion of an object relative to another about a pivot point or axis. In general, a pivoting motion refers to a rotational and/or angular motion imparted to an object relative to another which results in a change in angular orientation of this object of a given degree, ranging from a very small rotation (e.g., less than one degree) to one or more full circle rotations. Furthermore, a pivoting motion may be associated with an angular reorientation, generally expressed as a combination of one or more of tilting, panning, swivelling, or the like, but also optionally expressed as a variation in roll, pitch and/or yaw of the object in question. It will also be appreciated by the person of skill in the art that a pivoting motion may further comprise a translation component whereby such a pivoting motion of a given object provides for a generally arcuate and/or curvilinear motion of this object in combination, while still providing for an angular reorientation of this object relative to another.

As used herein, the term "about" refers to a ±10% variation from the nominal value. It is to be understood that such a variation is always included in any given value provided herein, whether or not it is specifically referred to.

Unless defined otherwise, all technical and scientific terms used herein have the same meaning as commonly understood by one of ordinary skill in the art to which this invention belongs.

The invention provides a luminaire comprising adjustable light modules. In particular, the luminaire, primarily configured for general illumination, comprises one or more light modules, each one of which comprising one or more light-emitting elements. In one embodiment, at least some of the light modules may comprise a respective heat sink in thermal contact therewith and/or an output optics for managing light output from the one or more light emitting elements. In general, the one or more light modules are adjustably coupled to the luminaire via a coupling structure and/or housing that provides one or more adjustment mechanisms for adjusting the orientation of the light modules, thereby adjusting an output directionality of the luminaire. In an embodiment wherein the light modules are coupled within a housing, the housing may generally comprise a light output portion (e.g. transparent or translucent window, cut-out, etc.) through which light emitted by the one or more light-emitting elements may be directed.

In one embodiment, the luminaire provides the ability to be cleanly aligned to the architectural and/or aesthetic setting within which it is used without significantly detracting from it, or creating significant visual clutter. As a result, the luminaire may be designed to provide adjustable lighting without significantly altering the general spatial profile of the luminaire (e.g., overall structure, configuration and/or architectural symmetry, etc.). The luminaire generally combines the functionality of an adjustable light source with a substantially maintainable spatial profile which can reduce an overall visual and/or aesthetic impact of the luminaire's adjustability on its environment and/or setting.

Light Module

The luminaire comprises one or more light modules each comprising one or more light-emitting elements. Each of the one or more light-emitting elements are operatively coupled to appropriate drive circuitry enabling the controllable operation of the one or more light-emitting elements. The one or more light-emitting elements can be thermally coupled to a thermal management system, for example a heat sink, or other such thermal management systems which provide a means for dissipation of heat generated by the one or more light-emitting elements during operation thereof. In addition, a light module can further comprise one or more optical elements in order to provide for the manipulation of the light generated by the one or more light-emitting elements of the light module. The optical elements can be configured to provide reflection, refraction, diffraction, collimation and/or other forms of optical manipulation in order that a desired light output is created by the one or more optical elements of the light module.

In one embodiment, each light module comprises one light-emitting element, such as a high brightness or high output light-emitting element, and a respective heat sink and output optics therefor. For instance, the light-emitting element of a given light module may be operatively coupled to a substrate having appropriate drive circuitry (e.g., printed circuit board—PCB, etc.), which is thermally coupled to the heat sink for dissipating heat generated by the driven light-emitting element. Output optics, such as a lens or the like, may be coupled to the light module in optical alignment with the light-emitting element.

In one embodiment, each light module comprises a 1 W to 5 W light-emitting element, such as a light-emitting diode or the like. Each light module may also comprise a collimating lens for collimating an output of its light-emitting element.

In another embodiment, the light module may comprise more than one light-emitting element, namely light-emitting elements of different colours, to provide a multicolour or combined colour output. For example, red, green and blue light-emitting elements may be combined in a single light module to provide a substantially white light source. Alternatively, red, amber, green and blue light-emitting elements may be combined. Plural light-emitting elements may also be combined in a given light module to provide a higher output light intensity or brightness. The person of skill in the art will readily understand that other such combinations can be considered without departing from the general scope and nature of the present disclosure.

In one embodiment, the output optics of the light module is provided via an output optics attachment permanently or removably attached to the light module. The output optics attachment can comprise an attachable casing having an output optical element at one end, and an attachment element at another for quick assembly to the light module. For instance, a lens may be mounted or moulded in a top part of the output optics attachment, and a set of attachment clips manufactured in a bottom part thereof for ready assembly of the light module.

In one embodiment, the output optics attachment of a light module is configured to be mounted atop the light-emitting element such that attachment clips thereof, or other such attachment elements, extend beyond the substrate upon which the one or more light-emitting elements are mounted, to engage an upper attachment lip portion of the light-module's heat sink, thereby maintaining a thermal coupling between the one or more light-emitting element and the heat sink. For example, coupling of the output optics attachments could be configured to apply an attachment pressure between the substrate and heatsink so to maintain thermal coupling. Alternatives to the above attachment mechanisms may include, but are not limited to, one or more of a magnetic element, a snap-fit element, a threaded element, a pressure-fit element, a suction element, and the like. A lens barrel, for instance to reduce emissions of light not directed through the output optical element, may further be provided within the output optics attachment to reduce unwanted emissions.

The person of skill in the art will readily understand that other attachment means, such as mechanical and/or magnetic attachment means, may be considered in the present example to provide similar results without departing from the general scope and nature of the present disclosure.

In accordance with a further embodiment, the heat sink of a light module is manufactured in accordance with a particular pattern in order to provide a high surface area for effective heat dissipation while providing a desired profile to the light module. For instance, rather than using a standard heat sink configuration, such as a parallel plate configuration or a 2D square peg array configuration, heat sinks may be designed in accordance with a functional requirement and desired profile. For example, FIGS. 1A to 1F illustrate six heat sink configurations, wherein each provides a desired heat dissipation surface, which may range from about 10 to 30 square inches, for example. Having regard to FIGS. 1A to 1F, each of the heat sink configurations are illustrated in a top perspective view, a side profile perspective view and a top view. In each case, the illustrated pattern can provide a desired level of heat dissipation while providing a desired aesthetic backing to the light module.

The person of skill in the art will understand that other such heat sink designs, having a desired physical configuration while providing a desired heat dissipation surface area, may be considered without departing from the general scope and nature of the present disclosure.

Coupling Structure and/or Housing

The one or more light modules of a luminaire are adjustably coupled to a coupling structure and/or within a housing that provides one or more adjustment mechanisms for adjusting the orientation of the light modules, thereby adjusting the output directionality of the luminaire. In general, the coupling structure allows for the aesthetic coupling of the one or more light modules within the luminaire and provides adjustability thereof without significantly altering the spatial profile of the luminaire.

In one embodiment, the coupling structure comprises a base portion mountable to a support structure and a light module coupling portion to which may be coupled the luminaire's one or more light modules. The base portion can be fixedly mountable whereas the light module coupling portion may be moved relative to the base portion to adjust a directionality of the light modules coupled thereto. For example, the light module coupling portion may pivot (e.g. pan, tilt, swivel, rotate, etc.) relative to the base portion. The coupling portion may further be adjusted in a linear fashion (e.g. up and down, side to side, etc.) or again in a combined motion (e.g. arcuate motion, curvilinear path, etc.).

In one embodiment, the coupling structure provides for the coupling of one or more linear arrays of light modules. In that respect, the coupling structure can comprise a single base portion and a substantially longitudinal light module coupling portion, for example. In another embodiment, the coupling structure comprises plural substantially longitudinal light module coupling portions for respective linear arrays of light modules.

In one embodiment, each light module is pivotally coupled to a bar to pivot about a respective axis, the bar itself pivoting about its own axis, or a longitudinal axis substantially parallel thereto. In one embodiment, the respective axes about which the light modules pivot are substantially perpendicular to the longitudinal axis. In another embodiment, the respective axes are substantially defined by respective axes of symmetry of the light modules (e.g. centre of gravity, geometrical centre, etc.). Optionally, or in addition thereto, the longitudinal axis is defined by an axis of symmetry of the luminaire.

In one embodiment, the longitudinal axis about which the bar, and the one or more light modules coupled thereto, pivot is substantially defined by, or closely positioned relative to, an axis of symmetry of the assembly. In one embodiment, the bar and multiple light modules are formed into a linear array of light modules configured to pivot about a longitudinal axis defined by the linear array, and each configured to pivot about respective axes substantially perpendicular thereto.

In one embodiment, the luminaire comprises one or more light modules each comprising one or more light-emitting elements capable of panning and tilting (e.g., having at least two pivoting degrees of freedom) within a substantially fixed housing that substantially defines and maintains the general spatial profile of the luminaire, thereby reducing visual clutter.

In one embodiment, the housing comprises an output portion through which light emitted from at least some of the one or more light modules may be directed. In one embodiment, the output portion comprises a transparent or translucent housing. In another embodiment, the housing comprises a fixed transparent or translucent portion (e.g. window) through which light output from the one or more light-emitting elements may be transmitted. In yet another embodiment, the housing comprises a moveable transparent or translucent portion that pivots along with the one or more light-modules and/or the one or more light module mounting portions so that a directionality thereof is accommodated by the spatial adjustment and/or alignment of the output portion. For example, the housing may comprise a substantially transparent output portion surrounded by a substantially opaque portion, wherein the transparent portion is adjustably coupled to, for example, the base portion of the housing and configured such that an adjustment of a directionality of the one or more light modules, either by pivot of the light module and/or the light module mounting portion, is accommodated by a similar adjustment of the output portion.

As will be understood by the person of skill in the art, various housing shapes and configurations may be considered without departing from the general scope and nature of the present disclosure. For instance, a linear or longitudinal housing may be selected for a luminaire comprising one or more linear arrays of light modules. A square or rectangular housing, or again a rounded or circular housing may also be considered depending on the number of light modules used and their general configuration, which may vary depending on the application for which the luminaire is designed. For example, in one embodiment, the housing comprises a smooth dome or tube housing.

Furthermore, the luminaire may comprise a coupling structure configured to be mounted vertically, horizontally, and/or in another alignment appropriate for the application for which the luminaire is designed. For instance, a substantially longitudinal luminaire may be mounted horizontally, for example hanging from a ceiling or shelving, or mounted vertically, for example on a wall or hanging vertically from a ceiling. Other such mounting configurations should be apparent to the person of skill in the art and are thus not considered to depart from the general scope and nature of the present disclosure.

Adjustment Mechanism

In general, the one or more light modules are adjustably coupled to the luminaire's coupling structure and/or within a luminaire housing.

In one embodiment, the one or more light modules are individually adjustable via respective adjustment mechanisms. Such individual mechanisms may comprise, for example, various mechanical joints such as pivot pins, coupling axles, universal joints, ball joints, or the like, or other adjustable coupling means, as would be readily apparent to the person of skill in the art. Individual adjustment of the one or more light modules may be performed manually, or again via motorised remote control.

In another embodiment, the luminaire comprises more than one light module, each one of which, or a subgroup thereof, being adjustable via a common adjustment mechanism.

In one embodiment, the pivot motions of the light modules (e.g., pan, swivel, tilt, etc.) are provided via one or more thumb wheels. In another embodiment pivot motions are provided via one or more levers. In yet another embodiment, pivot motions are provided via one or more electric motors optionally operated via remote control. In another embodiment, pivot motions are provided via a combination of at least some of the above mechanisms. The person of skill in the art will understand that the above and other such mechanisms, independently or in combination, may be considered without departing from the general scope and nature of the present disclosure.

In one embodiment, the one or more light modules are organised in one or more linear arrays, each one of which being adjustable as a group to provide a common directionality to each light module thereof. For example, each light module of a given linear array may be mechanically interconnected to move in unison. Such interconnection may be provided by an aiming bar or structure which, when moved, imparts a substantially same motion to each interconnected module.

In one embodiment, each light module of a linear array is pivotally coupled to a coupling bar or structure via a first set of pivot pins or axles. An aiming arm or structure interconnects the light modules via a second set of pivot pins or axles coupled to the light modules in spaced apart relation to the first set such that a substantially linear motion of the aiming arm or structure induces a pivoting motion of the light modules relative to the coupling bar. In one embodiment, the coupling bar is further pivotally coupled to a base portion of the coupling structure such that the linear array may further pivot about a longitudinal axis thereof, optionally via a pivoting motion of the same aiming arm.

Alternatively, each light module of a given array may be mechanically linked to a same drive mechanism which imparts a substantially same motion to each light module of the array. For instance, a motorised drive mechanism may be coupled to the light modules to adjust an orientation thereof, optionally via remote control.

In the above and other such embodiments, the one or more light modules may be adjusted manually (i.e., panned, tilted, rotated, etc.), wherein a user adjusts the one or more light modules directly, either before or after the luminaire is mounted or affixed to an appropriate mounting structure. Alternatively, adjustment of the one or more light modules may be automated, for example using a handheld remote control or the like, thereby allowing a user to adjust the directionality of the luminaire remotely. This alternative may be useful in an environment where the luminaire is mounted out of reach, for example on a high ceiling or the like, such that the luminaire's directionality may be adjusted to target a display in a retail store or museum, for example, without the need to climb and manually adjust the luminaire.

As will be readily understood by the person of skill in the art, other adjustment mechanisms may be considered to provide individual and/or group adjustment of the one or more light modules of a given luminaire without departing from the general scope and nature of the present disclosure.

The invention will now be described with reference to specific examples. It will be understood that the following examples are intended to describe embodiments of the invention and are not intended to limit the invention in any way.

EXAMPLES

Example 1

With reference to FIGS. 2 to 6, a luminaire, generally referred to using the numeral 100, and in accordance with one embodiment of the invention, will now be described. The luminaire 100 generally comprises a housing 102 and a linear array of light modules 104 adjustably coupled therein.

The housing 102 generally provides a coupling structure comprising a base portion 106, which is optionally fixedly or movably mountable to a support structure such as a wall, a ceiling, furniture (e.g., a cabinet, bookshelf, display case, etc.), or the like, and a light module coupling portion 108 pivotally coupled thereto. In general, the luminaire 100 is configured to be mounted horizontally, although one could consider coupling the luminaire 100 vertically, or in another orientation depending on the application for which it is used.

In this embodiment, the base portion 106 defines a longitudinal structure having attachment tabs 110 extending outwardly from opposed longitudinal ends thereof. The light module coupling portion 108, illustratively defined by a substantially longitudinal coupling bar, comprises a set of attachment tabs 112 at opposite ends thereof configured to pivotally engage the attachment tabs 110 of the base portion 106, thereby allowing the light module coupling portion 108 to pivot (as illustrated by arrows A) about a longitudinal axis 114 defined by the pivoting engagement of attachment tabs 110 and 112. The housing 102 may also comprise an optional transparent portion or window 116 that may be fixed (as in FIG. 2), removable (as in FIG. 3), or pivotally coupled to the light module coupling portion 108 to pivot therewith in order to accommodate the output directionality of the light modules 104 as they pivot with the coupling portion 108.

The light modules 104 each generally comprise one or more light-emitting elements (not explicitly shown) coupled to a substrate 118 (e.g., printed circuit board, etc.), a heat sink 120 thermally coupled thereto for managing heat generated thereby, and an output optics, such as lens 122 or the like, disposed to intercept and manage an optical output of the light-emitting element (e.g., focus, collimate, diffuse, etc.). In this particular embodiment, the output lens 122 of each light module 104 is fitted within an output-optics attachment 124 (e.g., see FIG. 6). This attachment 124 comprises a set of attachment clips 126 configured to engage an outer attachment lip 128 of the heat sink 120 and thereby secure the substrate 118 of the light emitting element in thermal contact therewith while positioning the output lens 122 in optical alignment with the output of the light-emitting element. A lens barrel 130 (e.g., see FIG. 5) may also be provided to reduce stray emissions not directed through the lens 122, whereas holes 131 may be added to provide electrical access (e.g., via wires 132) to the substrate 118 (e.g., a PCB thereof) in order to drive the light-emitting element.

In general, each light module 104 is coupled to the light module coupling portion 108 via respective axle pins 134 disposed along the length of the coupling portion 108 and oriented substantially perpendicular thereto, thereby defining respective transversal axes about which the light modules 104 may pivot (as illustrated by arrows B). In this particular embodiment, the axles 134 are coupled between the coupling portion 108 and the respective heat sinks 120 of the light modules 104. Alternatively, the axles 134 could couple the light modules 104 to the coupling portion 108 via a dedicated structure either integrally or removably fitted to the light module 104, or again via an extension of the heat sink 120, the output optics attachment 124, the substrate 118, or the like. The person of skill in the art will understand that other configurations can be considered without departing from the general scope and nature of the present disclosure.

The luminaire 100 also generally comprises either an integrated and/or removable power source, for example, disposed within the base portion 106, or again comprises means for connecting the luminaire 100 to an external power source, namely a power line provided via a structure, wall or ceiling to which is mounted the luminaire 100. Power is then provided to the light modules 104 via electrical wiring 132, thereby serially connecting the light-emitting elements thereof, for example. Parallel circuitry may also be considered herein, as will be apparent to the person of skill in the art, for example, to impart independent or grouped control of the light modules and/or one or more light-emitting elements thereof.

As depicted by arrows A and B, the light modules 104 may be adjusted both via a pivoting motion of the coupling portion 108 about the longitudinal axis 114 and/or via a pivoting motion of the light modules 104 themselves about axle pins 134. As such, the output of the luminaire 100 may be tilted and/or panned as required to provide a desired lighting effect. To accomplish these adjustments, an adjustment wheel, lever and/or motorised remote control may be provided. For example, a thumb wheel may be provided to adjust a pivot angle of the coupling portion 108, while an aiming arm interconnecting each light module 104, or a subgroup thereof, may be provided to adjust a pivot angle of these modules 104. For the latter example, an aiming arm, such as arm 136 of FIG. 5, may be coupled to the light modules 104 via a set of axle pins 138 spaced apart from axle pins 134 such that a linear motion of the aiming arm 136 (as illustrated by arrow C) induces a pivoting motion of the light modules 104 relative to the support portion 108 (as illustrated by arrow B) thereby panning or tilting the output of the light module 104 (as illustrated by arrow D).

Furthermore, adjustment of the various pivot angles of the light-emitting elements 104 can be accomplished without significantly altering the spatial profile of the luminaire 100. In particular, as the light modules 104 are adjusted relative to the housing 102, the generally longitudinal spatial profile of the luminaire 100 is substantially maintained. That is, the reorientation of the light modules 104 within the housing 102 do not significantly affect the overall position, alignment, shape, disposition and architectural symmetry of the luminaire 100, and that, whether a housing window 116 is used or not. As such, the luminaire 100 generally provides an adjustable beam while maintaining a substantially fixed spatial profile.

Figure 11:
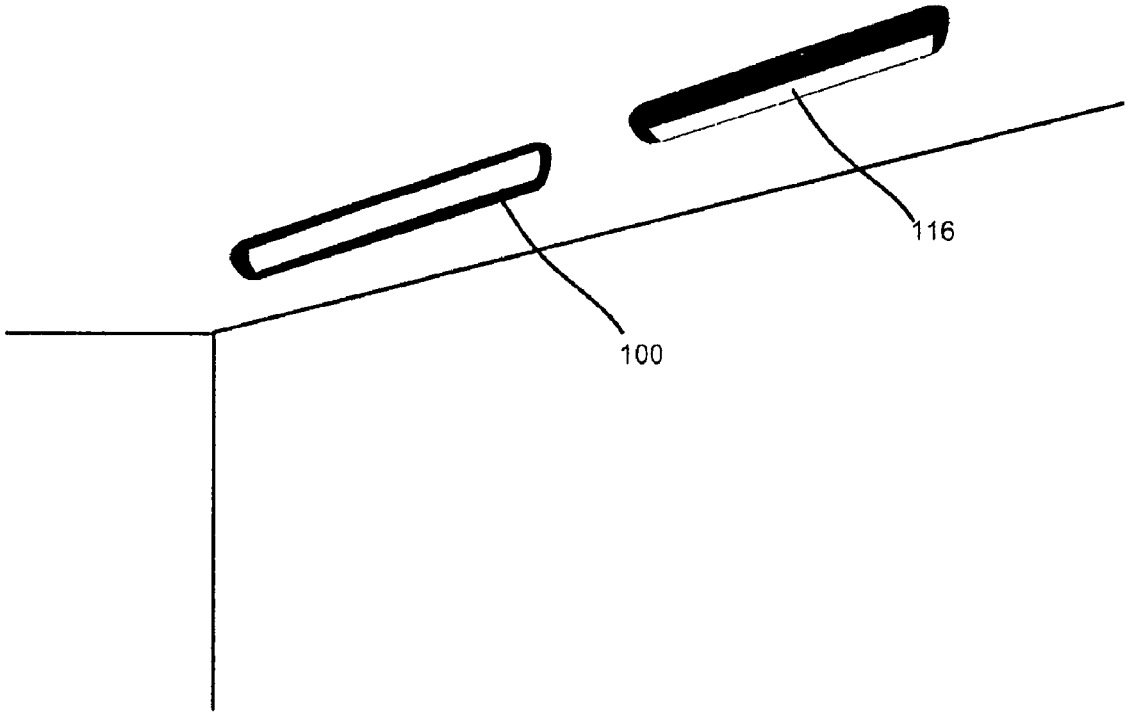
FIG. 11 is a perspective view of substantially linear luminaires each comprising a housing having a substantially opaque portion and an output portion adjustable to adjust a directionality thereof.

In FIG. 11, two luminaires 100 are depicted as mounted in a linear fashion to hang from a ceiling, the directionality thereof being dictated by the common directionality of the light modules (not shown) and output portion 116 of each luminaire. In this particular example, the output portion comprises a substantially transparent portion surrounded by a substantially opaque portion, the transparent portion being pivotable about a longitudinal axis of the luminaire to follow an adjustment of the light modules thereof.

Example 2

With reference now to FIGS. 7A to 7F, a luminaire, generally referred to using the numeral 200, and in accordance with another embodiment of the invention, will now be described. The luminaire 200 generally comprises a coupling structure 202 and a linear array of light modules 204 adjustably coupled thereto.

The coupling structure 202 generally comprises a base portion 206, which is optionally fixedly or movably mountable to a support structure such as a wall, a ceiling, furniture (e.g., a cabinet, bookshelf, display case, etc.), and the like, and a light module coupling portion 208 pivotally coupled thereto. In general, the luminaire 200 is configured to be mounted vertically, although one could consider mounting the luminaire 200 in other orientations depending on the application for which it is used.

In this embodiment, the light module coupling portion 208, illustratively defined by a substantially longitudinal coupling bar, comprises an attachment tab 212 at a longitudinal end thereof configured to pivotally engage the base portion 206, thereby allowing the light module coupling portion 208 to pivot (as illustrated by arrows E) about a longitudinal axis 214 defined by the pivoting engagement of attachment tab 212 to the base portion 206. In this embodiment, the longitudinal axis is substantially defined by a longitudinal geometrical axis of symmetry of the luminaire. The coupling structure 202 may also comprise an optional transparent portion or window (not shown) that may be fixed, removable, or pivotally coupled to the light module coupling portion 208 to pivot therewith in order to accommodate the output of the light modules 204 as they pivot with the coupling portion 208.

The light modules 204 each generally comprise one or more light-emitting element (not explicitly shown) coupled to a substrate 218 (e.g., printed circuit board, etc.), a heat sink 220 thermally coupled thereto for managing heat generated thereby, and an output optics, such as lens 222 or the like, disposed to intercept and manage an optical output of the light-emitting element (e.g., focus, collimate, diffuse, etc.). As in the embodiment described in Example 1, the output lens 222 of each light module 204 may again be fitted within an output-optics attachment 224 that engages the heat sink 220 to thereby secure the substrate 218 of the light emitting element in thermal contact therewith while positioning the output lens 222 in optical alignment with the light-emitting element. A lens barrel to reduce stray emissions not directed through the lens 222, and electrical access holes, may again also be provided as described hereinabove.

In general, each light module 204 is coupled to the light module coupling portion 208 via respective axle pins 234 disposed along the length of the coupling portion 208 and oriented substantially perpendicular thereto, thereby defining respective transversal axes about which the light modules 204 may pivot (as illustrated by arrows F). In one embodiment the respective transversal axes are substantially defined by respective transversal geometrical axes of symmetry of the light modules. In this particular embodiment, the axles 234 are again coupled between the coupling portion 208 and the respective heat sinks 220 of the light modules 204. Alternatively, the axles 234 could couple the light modules 204 to the coupling portion 208 via a dedicated structure either integrally or removably fitted to the light module 204, or again via an extension of the heat sink 220, the output optics attachment 224, the substrate 218, or the like. The person of skill in the art will again understand that other configurations can be considered without departing from the general scope and nature of the present disclosure.

The luminaire 200 also generally comprises either an integrated and/or removable power source, for example, disposed within the base portion 206, or again comprises means for connecting the luminaire 200 to an external power source, namely a power line provided via a structure, wall or ceiling to which is mounted the luminaire 200. Power is then provided to the light modules 204 via electrical wiring 232 thereby serially connecting the light-emitting elements thereof.

As depicted by arrows E and F, the light modules 204 may be adjusted both via a pivoting motion of the coupling portion 208 about the longitudinal axis 214 and/or via a pivoting motion of the light modules 204 themselves about axle pins 234. As such, the output of the luminaire 200 may be tilted and/or panned as required to provide a desired lighting effect. To accomplish these adjustments, an adjustment wheel, lever and/or motorised remote control may be provided. For example, a thumb wheel may be provided to adjust a pivot angle of the coupling portion 208, while an aiming arm interconnecting each light module 204, or a subgroup thereof, may be provided to adjust a pivot angle of these modules 204.

In this particular example, an aiming arm 236 is coupled to the light modules 204 via a set of axle pins 238 spaced apart from axle pins 234 such that a linear motion of the aiming arm 236 induces a pivoting motion of the light modules 204 relative to the support portion 208 thereby panning/tilting the output of the light module 204. The coupling portion 208 may also be pivoted via a rotation of aiming arm 236, such that a full adjustability of the luminaires directionality is accessible via a single aiming arm 236.

Furthermore, adjustment of the various pivot angles of the light-emitting elements 204 can be accomplished without significantly altering the spatial profile of the luminaire 200. In particular, as the light modules 204 are adjusted relative to the support structure 202, the generally longitudinal spatial profile of the luminaire 200 is substantially maintained. That is, the reorientation of the light modules 204 do not significantly affect the overall position, alignment, shape, disposition and architectural symmetry of the luminaire 200. As such, the luminaire 200 generally provides an adjustable beam while maintaining a substantially fixed spatial profile.

The person of skill in the art will understand that other such heat sink designs, sharing a similar aesthetic appeal while providing a large heat dissipation surface area, may be considered without departing from the general scope and nature of the present disclosure.

Example 3

Figure 8:
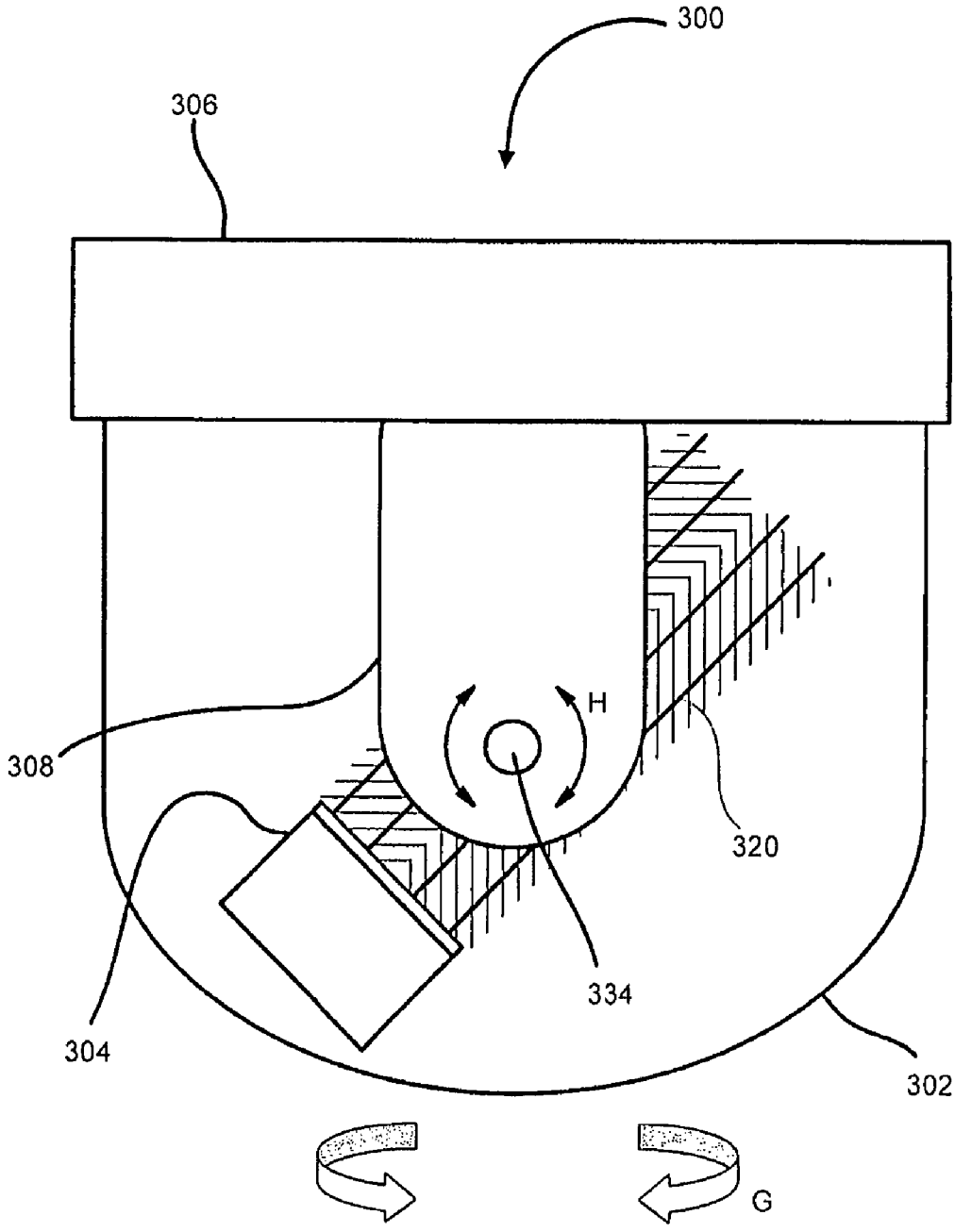
FIG. 8 is a side view of a luminaire comprising an adjustable light module mounted within a housing, in accordance with another embodiment of the invention.
Figure 9:
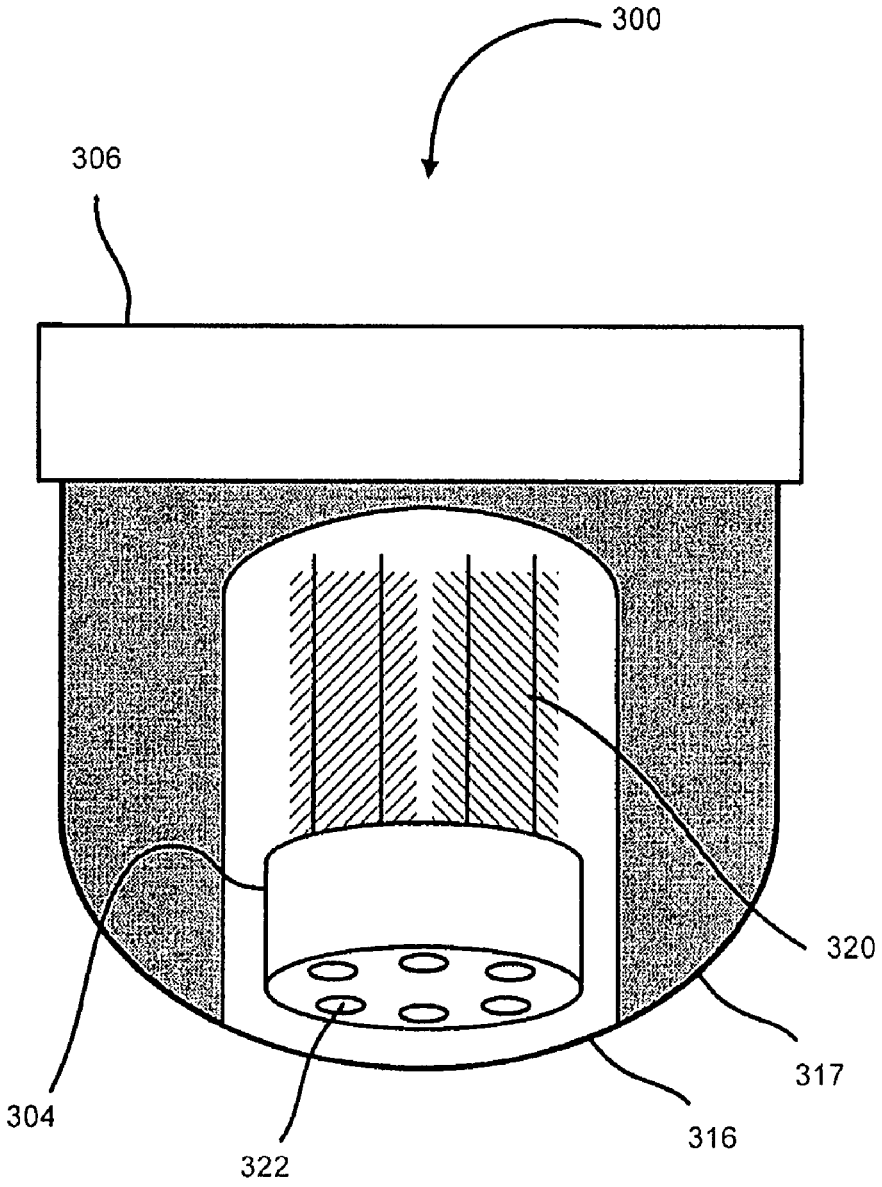
FIG. 9 is a front view of the luminaire of FIG. 8, the housing comprising a substantially opaque portion and an output portion adjustable with the light module to adjust a directionality thereof.
Figure 10:
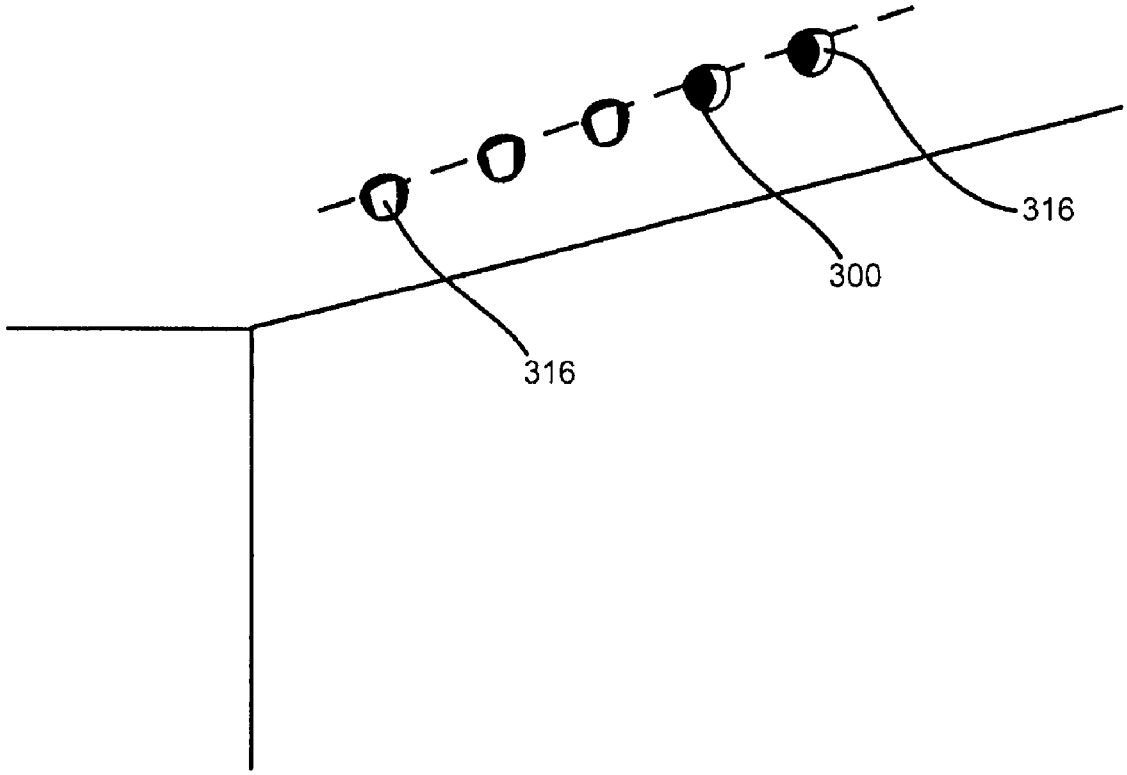
FIG. 10 is a perspective view of a linear array of luminaires such as the luminaire of FIG. 9.

With reference to FIGS. 8 to 10, a luminaire, generally referred to using the numeral 300, and in accordance with another embodiment of the invention, will now be described. The luminaire 300 generally comprises a housing 302 and a light module 304 adjustably coupled therein.

The housing 302 generally provides a coupling structure comprising a base portion 306, which is optionally fixedly or movably mountable to a support structure such as a wall, a ceiling, furniture (e.g., a cabinet, bookshelf, display case, etc.), or the like, and a light module coupling portion 308 pivotally coupled thereto.

In this embodiment, the base portion 306 defines a circular structure having a central rotational coupling (not shown) to the light module coupling portion 308, illustratively defined by substantially parallel coupling tabs configured to pivotally engage the light module 304 via a heatsink 320 thereof.

The housing 302 further comprises a dome-like structure comprising a substantially opaque portion 317 and a transparent portion or window 316 configured to move with the light module coupling portion 308 and/or the light-module 304 to pivot therewith in order to accommodate the output directionality of the light modules 304 as they pivot with the coupling portion 308.

The light module 304 generally comprises one or more light-emitting elements (i.e. six shown in this example) coupled to a substrate (e.g., printed circuit board, etc.), a heat sink 320 thermally coupled thereto for managing heat generated thereby, and an output optics, such as respective outputs 322 or the like, disposed to intercept and manage an optical output of the light-emitting elements (e.g., focus, collimate, diffuse, etc.).

The luminaire 300 also generally comprises either an integrated and/or removable power source, for example, disposed within the base portion 306, or again comprises means for connecting the luminaire 300 to an external power source, namely a power line provided via a structure, wall or ceiling to which is mounted the luminaire 300.

As depicted by arrows G and H, the light modules 304 may be adjusted both via a pivoting motion of the coupling portion 308 and/or via a pivoting motion of the light module 304 about pins 334. As such, the output of the luminaire 300 may be tilted and/or panned as required to provide a desired lighting effect. Adjustment of the pivot angles of the light module 304 can be accomplished without significantly altering the spatial profile of the luminaire 300. In particular, as the light module 304 is adjusted relative to the housing 302, the spatial profile of the luminaire 300 is substantially maintained. That is, the reorientation of the light module 304 within the housing 302 does not significantly affect the overall position, alignment, shape, disposition and architectural symmetry of the luminaire 300. As such, the luminaire 300 generally provides an adjustable beam while maintaining a substantially fixed spatial profile.

In FIG. 10, a series of luminaires 300 are depicted as mounted in a linear fashion to hang from a ceiling, the directionality thereof being dictated by the common directionality of the light module (not shown) and output portion 316 of each luminaire. In this particular example, the output portion comprises a substantially transparent portion surrounded by a substantially opaque portion, the transparent portion being pivotable to follow an adjustment of the light module thereof.

It is apparent that the foregoing embodiments of the invention are examples and can be varied in many ways. Such present or future variations are not to be regarded as a departure from the spirit and scope of the invention, and all such modifications as would be readily understood to one skilled in the art are intended to be included within the scope of the following claims.

I claim:

1. A luminaire for providing general illumination, comprising:

a housing defining a spatial profile for the luminaire, said housing comprising an output portion; and one or more light modules pivotally coupled within said housing, each of said one or more light modules comprising a light-emitting element, and a respective heat sink and output optics therefor;

wherein said one or more light modules are configured to pivot within said housing to thereby adjust a directionality of the light emitted therefrom through said output portion while substantially maintaining the spatial profile of the luminaire;

said luminaire further having a substantially longitudinal light-module coupling portion pivotally coupled within said housing to pivot about a longitudinal axis that is substantially parallel thereto, said one or more light modules being pivotally coupled to said coupling portion to pivot about a respective transversal axis that is substantially perpendicular to said longitudinal axis;

said respective output optics of at least some of said one or more light modules being provided by an output optics attachment comprising an output optical element and an attachment element, said output-optics attachment being configured to engage said heat sink and said light-emitting element via said attachment element to maintain a thermal coupling between said light-emitting element and said heat sink, while positioning said optical element in optical alignment with an output of said light-emitting element;

wherein said attachment element is configured to engage a substrate of said light-emitting element and apply an attachment pressure thereon relative to said heat sink thereby enabling said thermal coupling therebetween;

wherein said heat sink comprises one or more attachment lips and said attachment element comprising one or more clips configured to extend beyond said substrate while engaging same and couple to respective ones of said one or more attachment lips.

2. The luminaire as claimed in claim 1, the luminaire comprising two or more light modules coupled along said coupling portion to form a substantially linear array, wherein said output portion comprises a substantially longitudinal transparent portion disposed so to enable the light emitted from said linear array of light modules to be transmitted through said transparent portion.

3. The luminaire as claimed in claim 1, wherein said one or more light-emitting elements are pivotally coupled within said housing via pivoting coupling of said respective heatsink thereof within said housing.

4. The luminaire as claimed in claim 1, comprising two or more light modules and further comprising an adjustment mechanism interconnecting said two or more light modules, said adjustment mechanism being configured to impart in unison a substantially same pivoting motion to each of said light modules relative to said housing to thereby adjust a substantially common directionality thereof.

5. The luminaire as claimed in claim 1, said output portion comprising an adjustable output portion configured to pivot with said one or more light modules to adjust said directionality.

6. The luminaire as claimed in claim 1, said output portion comprising a substantially transparent portion, said housing further comprising a substantially opaque portion surrounding said output portion to restrict an output of the luminaire.

7. A light module for use in a general illumination luminaire, the light module comprising:

a housing;

a heat sink;

a light-emitting element, and an output-optics attachment comprising an output optical element and an attachment element, said output-optics attachment being configured to engage said heat sink and said light emitting element via said attachment element to maintain a thermal coupling between said light-emitting element and said heat sink, while positioning said optical element in optical alignment with an output of said light-emitting element;

wherein said attachment element is configured to engage a substrate of said light-emitting element and apply an attachment pressure thereon relative to said heat sink thereby enabling said thermal coupling therebetween;

said heat sink comprising one or more attachment lips and said attachment element comprising one or more attachment clips configured to extend beyond said substrate while engaging same and couple to respective ones of said one or more attachment lips;

wherein said output optics element and heat sink of said luminaire is pivotally coupled with said housing about a longitudinal axis substantially parallel thereto and pivotally coupled with said housing to pivot about respective transversal axis that is substantially perpendicular to said longitudinal axis.

8. The light module as claimed in claim 7, wherein said attachment element comprises a snap-fit attachment element.

9. A luminaire having individual adjustment light modules, comprising:

a housing supporting a plurality of light modules;

said housing defining a spatial profile of said luminaire and having an output portion;

wherein each of said plurality of light modules are pivotally coupled to said housing, each of said plurality of light modules having a light emitting element, a heat sink and an output optics module;

wherein each of said plurality of light modules pivot within said housing about a longitudinal axis substantially parallel to said luminaire;

wherein each of said plurality of light modules pivots with respect to said luminaire about a transversal axis that is substantially perpendicular to said longitudinal axis of said luminaire;

each of said output optics for each of said light modules having an attachment structure, said attachment structure being configured to operably engage a heat sink on said light module and maintaining a thermal coupling between said light module output optic and said heat sink;

said attachment structure engaging a substrate of said light module and applying attachment pressure enabling thermal coupling to said heat sink;

wherein said heat sink has at least one attachment lip, said attachment structure having at least one clip extending beyond said substrate and coupling said structure to said heat sink.

* * * * *